US005546896A

United States Patent [19]

Zaiser

[11] Patent Number: 5,546,896

[45] Date of Patent: Aug. 20, 1996

[54] ARTICULATED, OIL-COOLED PISTON FOR INTERNAL COMBUSTION ENGINES

[75] Inventor: Dieimar Zaiser, Fellbach, Germany

[73] Assignee: Mahle GmbH, Stuttgart, Germany

[21] Appl. No.: 503,824

[22] Filed: Jul. 18, 1995

[30] Foreign Application Priority Data

Aug. 25, 1994 [DE] Germany ..... 44 30 137.5

[51] Int. Cl.[6] ..... F02F 3/22

[52] U.S. Cl. ..... 123/193.6; 92/186

[58] Field of Search ..... 123/193.6; 92/186, 92/174, 255

[56] References Cited

U.S. PATENT DOCUMENTS

| | | | |
|---|---|---|---|
| 3,221,718 | 12/1965 | Isley | 123/193.6 |
| 5,052,280 | 10/1991 | Kopf et al. | 92/186 |
| 5,144,923 | 9/1992 | Leites et al. | 123/193.6 |
| 5,261,363 | 11/1993 | Kemnitz | 123/193.6 |
| 5,317,958 | 6/1994 | Leites et al. | 123/193.6 |

FOREIGN PATENT DOCUMENTS

| | | |
|---|---|---|
| 252638A1 | 12/1987 | German Dem. Rep. . |
| 3643049A1 | 6/1988 | Germany . |
| 4134530A1 | 5/1992 | Germany . |
| 4039751A1 | 6/1992 | Germany . |
| 4039754A1 | 6/1992 | Germany . |

*Primary Examiner*—Marguerite McMahon
*Attorney, Agent, or Firm*—Collard & Roe, P.C.

[57] ABSTRACT

An articulated oil-cooled piston for internal combustion engine extending along a longitudinal axis and including a piston skirt, a piston head with bosses, annular ribs and a piston pin disposed within the bosses for connecting the piston skirt and a connecting rod to the piston head. The piston head includes a ring belt which defines an outer border of an annular cooling oil duct. The annular cooling oil duct has a downwardly-facing opening which is covered by an annular plate. The annular plate is radially divided into plate parts, which are radially inserted into slots formed near the bottom end of the ring belt. When fully installed, the plate parts are disposed within a common plane which is oriented perpendicular to the piston axis.

7 Claims, 2 Drawing Sheets

ARTICULATED, OIL-COOLED PISTON FOR INTERNAL COMBUSTION ENGINES

BACKGROUND OF THE INVENTION

1. Field of the Invention

The present invention relates to an articulated, oil-cooled piston for an internal combustion engine. More particularly, the invention relates to a piston having an annular plate covering an annular cooling oil duct in the piston head.

2. The Prior Art

Pistons are known from German Patent 42 08 037, which corresponds to U.S. Pat. No. 5,261,363. In this reference, the annular plate used for covering the hollow space defining the cooling oil chamber is a suitably divided, radially-fixed tensioned plate spring. The plate spring freely rests radially inside and outside on respective axially-opposed supports.

In the known embodiment, the expense and expenditure in manufacturing the special support areas for the plate spring is a drawback. It is also a disadvantage that the tensioned plate spring produces undesirable torque on the piston head. It would therefore be desirable to provide an annular plate which is simply supported within the piston head in an untensioned state.

SUMMARY OF THE INVENTION

It is therefore an object of the present invention to overcome the drawbacks of the prior art and to provide an articulated piston equipped with a simply-constructed cooling oil duct.

It is a further object of the present invention to provide an annular plate which is simply installed to cover the cooling oil chamber.

These and other related objects are achieved according to the invention by an articulated, oil-cooled piston for an internal combustion engine. The piston extends along a longitudinal axis and includes a piston skirt, a piston head with bosses and annular ribs. A piston pin is disposed within the bosses for connecting the piston skirt and a connecting rod to the piston head. The piston head comprises a ring belt having a lower end and at least one ring groove. The ring belt defines an outer border of an annular cooling oil duct which is positioned radially inwardly of the ring belt. The annular cooling oil duct has an opening adjacent the lower end and surrounds the bosses and annular ribs. The ring belt has slots formed adjacent the lower end. An annular plate covers the annular cooling oil duct approximately at the height of the lower end. The annular plate is radially divided into plate parts each having an outer periphery. The plate parts are radially inserted into respective slots whereby the plate parts are disposed in a common plane oriented perpendicular to the piston axis with the outer periphery supported by the slot.

The piston head includes a diametrically-positioned pressure/counter-pressure direction. The slots are interrupted, i.e. end, in the vicinity of the pressure/counter-pressure direction. The plate parts are restricted from rotation about the piston axis by contact with the ends of slots in the vicinity of the pressure/counter-pressure direction. The ring belt includes two diametrically-opposed slots. The annular ribs include a groove for supporting an inner periphery of the plate parts. The ring belt includes a groove disposed radially outwardly of the slots. The ring belt includes a bore above each slot and each of the plate parts includes a flap which engages the bore to restrict radially-outward movement of the plate parts. The ring belt includes two diametrically-opposed slots, with a bore centrally positioned within each slot.

BRIEF DESCRIPTION OF THE DRAWINGS

Other objects and features of the present invention will become apparent from the following detailed description considered in connection with the accompanying drawings which disclose an embodiment of the present invention. It should be understood, however, that the drawings are designed for the purpose of illustration only and not as a definition of the limits of the invention.

DETAILED DESCRIPTION OF THE PREFERRED EMBODIMENT

Figure 1:
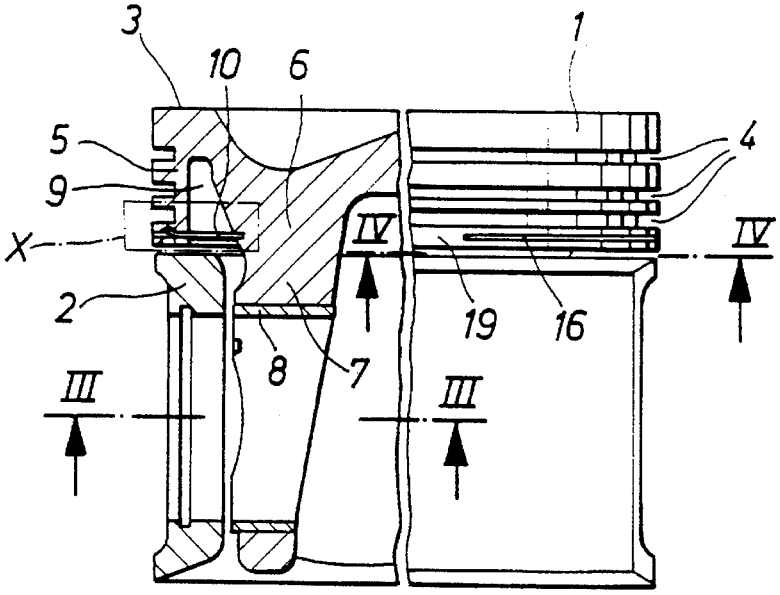
FIG. 1 is a side elevational view, in part cross-section, of a piston according to the invention.
Figure 2:
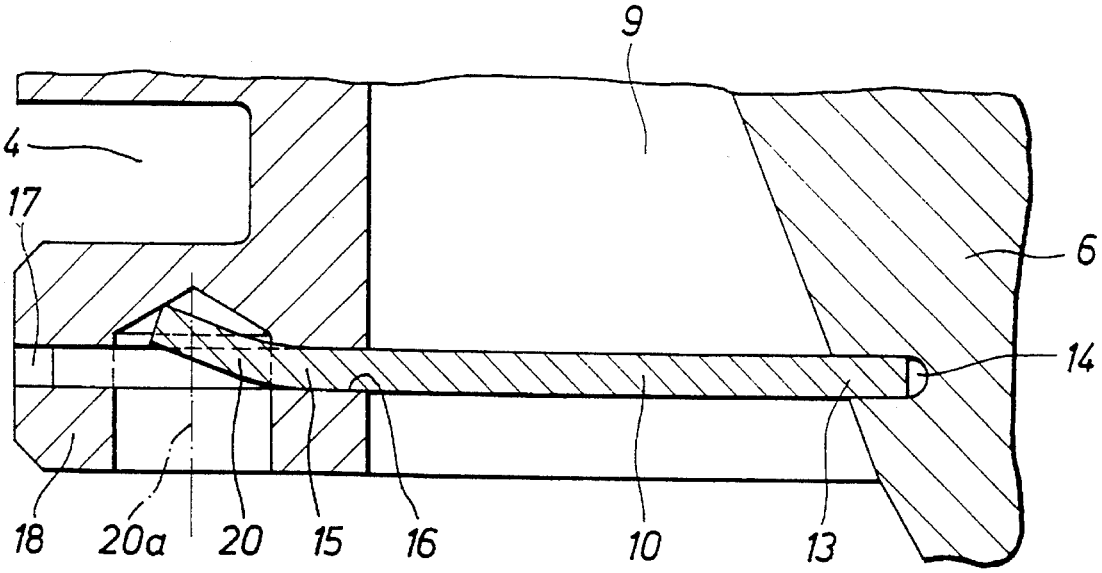
FIG. 2 is an enlarged view of region X from FIG. 1.

Referring now in detail to the drawings and in particular FIGS. 1 and 2 there is shown an articulated, jointed or multi-part piston consisting of a piston head 1 and a piston skirt 2 which are coupled together by a piston pin or gudgeon pin. The pin is not shown in the FIGS. for the sake of clarity. Piston head 1 includes an outer ring belt 5 which contains grooves 4 for accommodating piston rings. Ring belt 5 extends downwardly from a top portion 3 of piston head 1 to the bottom of piston head 1. Annular ribs 6 are positioned radially inwardly from ring belt 5 to connect top part 3 to bosses 7. A bushing 8 may be provided within bosses 7 for contacting the piston pin. Between annular rib 6 and ring belt 5 there is an annular chamber or ring-shaped cavity 9 which is covered by an annular ring or plate spring 10, to form a closed cooling oil chamber.

Figure 5:
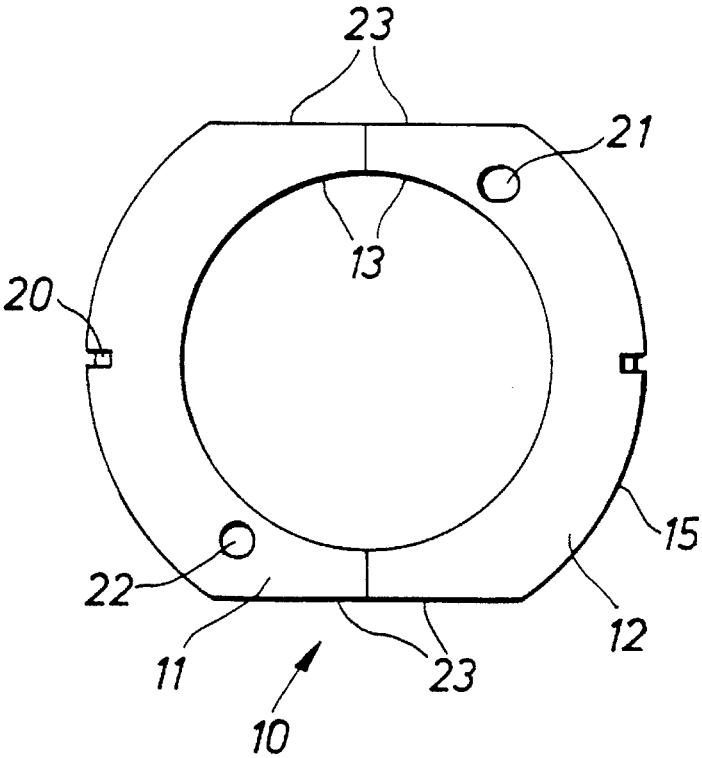
FIG. 5 is a top plan view of an annular plate.

As can be seen in FIG. 5 annular plate 10 is divided into two plate parts 11 and 12. The inner periphery or rim 13 of plate parts 11 and 12 resides within a groove 14 located within annular rib 6, as can be seen in FIG. 2. Plate parts 11 and 12 have an outer periphery or rim 15 which is located in a slot 16. Radially outwardly of slot 16 is a groove 17 positioned below grooves 4. Groove 17 is used to insert annular plate 11 into slot 16 and groove 14. Slot 16 and groove 17 are positioned near a free end 18 at the lower extent of ring belt 5.

Figure 4:
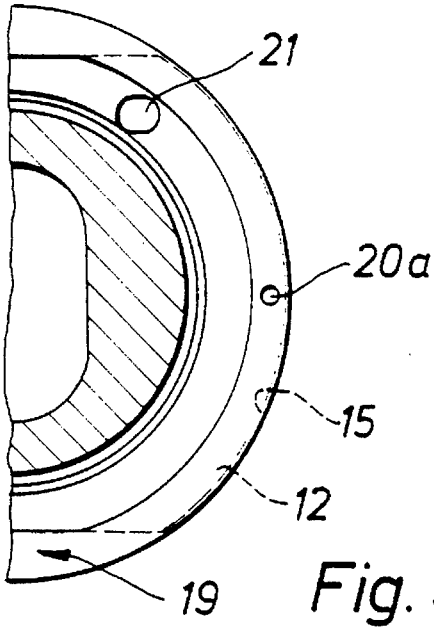
FIG. 4 is a cross-sectional view taken along the line IV—IV from FIG. 1.

Slots 16 may be cut into piston head 1 with a circular saw, for example. Along the circumference of piston head 1, diametrically-opposed areas 19 are located in the pressure/counter-pressure direction. The pressure/counter-pressure direction is arranged transversed to the piston pin axis. Slots 16 are terminated or interrupted in the vicinity of areas 19 across an approximately 30° angle. Also in areas 19, free end 18 is connected with ring belt 5. As can be seen in FIGS. 2 and 4, a bore **20*a* extends upwardly through lower end 18 of ring belt 5. As can be seen in FIGS. 2 and 5 a flap 20 formed on outer rim 15 of annular plate 10 engages bore 20*a* to hold annular ring 10** in position.

Figure 3:
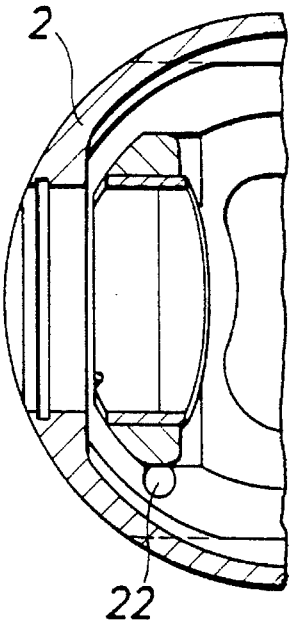
FIG. 3 is a cross-sectional view taken along the line III—III from FIG. 1.

In order to supply cooling oil into chamber 9, a hole or opening 21 is provided in plate part 12, as shown in FIGS. 4 and 5. A further hole or opening 22 is provided in plate part 11 for discharging oil from chamber 9, as shown in FIGS. 3 and 5. Cooling oil is injected upwardly into opening 21. The cooling oil circulates clockwise and counter-clockwise throughout oil chamber 9 as the piston reciprocates along its central, longitudinal axis. The location of oil chamber 9 adjacent ring belt 5, top end 3 and annular ribs 6, serves to cool the upper peripheral extent of piston head 1. After the oil travels 180° around the periphery of the piston, it is discharged downwardly through opening 22.

As can be seen in FIGS. 4 and 5 annular plate 10 includes two opposed rectilinear sides 23, where plate parts 11 and 12 meet. Rectilinear sides 23 are positioned against areas 19 so that annular plate 10 is prevented from rotating within slots 16 around the piston axis. The annular plate 10 according to the invention provides a simply constructed structure for closing oil chamber 9 within an articulated piston. Oil chamber 9 extends around the entire periphery of piston head 1 to circulate cooling oil therethrough. Annular plate 10 is restricted from moving radially outwardly by flaps 20 and prevented from rotating due to contact between rectilinear sides 23 and areas 19.

While only a single embodiment of the present invention has been shown and described, it is to be understood that many changes and modifications may be made thereunto without departing from the spirit and scope of the invention as defined in the appended claims.

What is claimed is:

1. An articulated, oil-cooled piston for an internal combustion engine, the oil-cooled piston extending along a longitudinal axis and including a piston skirt, a piston head with bosses, annular ribs and a piston pin disposed within the bosses for connecting the piston skirt and a connecting rod to the piston head, the piston head comprising:

a ring belt having a lower end and at least one ring groove, said ring belt defining an outer border of an annular cooling oil duct which is positioned radially inwardly of said ring belt, said annular cooling oil duct surrounding said bosses and said annular ribs and having an opening adjacent said lower end, said ring belt having two diametrically opposed slots formed adjacent said lower end; and an annular plate covering said annular cooling oil duct approximately at the height of said lower end, said annular plate being radially-divided into plate parts each having an outer periphery, said plate parts being radially inserted into respective slots whereby said plate parts are disposed in a common plane oriented perpendicular to the piston axis with said outer periphery supported by the slots.

2. The articulated, oil-cooled piston according to claim 1, wherein the piston head includes a diametrically-positioned pressure/counter-pressure direction, wherein the slots have ends at said pressure/counter-pressure direction.

3. The articulated, oil-cooled piston according to claim 2, wherein said plate parts are restricted from rotation about the piston axis by contact with the ends of the slots.

4. The articulated, oil-cooled piston according to claim 1, wherein the annular ribs include a groove for supporting an inner periphery of said plate parts.

5. The articulated, oil-cooled piston according to claim 1, wherein said ring belt includes a groove disposed radially outwardly of the slots.

6. The articulated, oil-cooled piston according to claim 1, wherein said ring belt includes a bore above each slot and each of said plate parts includes a flap which engages the bore to restrict radially outward movement of said plate parts.

7. The articulated, oil-cooled piston according to claim 6, wherein said ring belt includes two diametrically-opposed slots, with a bore centrally positioned within each slot.

* * * * *